United States Patent [19]

Saunders

[11] 4,248,205

[45] Feb. 3, 1981

[54] VARIABLE DRAFT PROVIDER FOR FIREPLACE

[76] Inventor: Percy L. Saunders, 893 Regatta Rd., Charleston, S.C. 29412

[21] Appl. No.: 7,235

[22] Filed: Jan. 29, 1979

[51] Int. Cl.[3] ..... F24B 13/02

[52] U.S. Cl. ..... 126/143; 126/120; 126/242

[58] Field of Search ..... 126/143, 120, 121, 164, 126/242-245, 112, 85 B; 237/51

[56] References Cited

U.S. PATENT DOCUMENTS

| | | | |
|---|---|---|---|
| 494,046 | 3/1893 | Vance | 126/143 |
| 1,430,781 | 10/1922 | Ackroyd | 126/120 |
| 1,497,123 | 6/1924 | Sala | 126/121 |
| 2,103,171 | 12/1937 | Nilson | 126/120 |
| 4,106,475 | 8/1978 | Mayes | 126/143 |
| 4,136,666 | 1/1979 | Haas | 126/143 |
| 4,137,895 | 2/1979 | Bittinger | 126/120 |

FOREIGN PATENT DOCUMENTS

| | | | |
|---|---|---|---|
| 764843 | 1/1957 | United Kingdom | 126/143 |

*Primary Examiner*—James C. Yeung
*Attorney, Agent, or Firm*—Larry H. Kline

[57] ABSTRACT

A device is disclosed which provides air for a fireplace comprising a structure which is placed over the clean-out opening of the fireplace.

7 Claims, 7 Drawing Figures

VARIABLE DRAFT PROVIDER FOR FIREPLACE

This invention relates to a device for admitting outside air into a fireplace and more particularly to a device with a variable air control.

It is well known that an open fireplace in a home is quite inefficient. Glass fireplace screens covering the fireplace opening increase the fireplace efficiency. Ordinarily, the air utilized for draft purposes by the fireplace is drawn from inside the house through the fireplace opening. Therefore, inside air which has been previously heated is utilized to provide the draft for fireplace combustion. The present invention enables previously heated air to remain in the house and utilizes unheated outside air to be drawn through the fireplace to provide the draft for fireplace combustion.

An object of the present invention is to provide a device which admits outside air to provide draft for fireplace combustion.

Another object of the present invention is to provide a device which admits outside air to provide draft for fireplace combustion with the device having a variable air control.

Still another object of the present invention is to provide a device which admits outside air to provide draft for fireplace combustion which utilizes the clean-out opening which may be found in many fireplaces.

A further object of the present invention is to provide a device which provides a fireplace with greater efficiency for the home by not utilizing inside air to provide draft for fireplace combustion.

Another object of the present invention is to provide variable air openings within a device designed to promote appropriate directional flow and volume of air for a burning fire.

Still another object of the present invention is to provide a device designed in a manner that it may be constructed with a minimum of wasted materials and labor.

Another object of the present invention is to utilize side flaps for a device which permits some air flow through the device even when the flaps are in a closed position.

These and other objects and features of the invention will be apparent from the following description and appended claims.

Briefly, the invention is a device for providing air for a fireplace comprising a structure which is placed over the clean-out opening of the fireplace. The structure may comprise a member with an opening and a cover for the opening. The member may be a side, and the opening a side opening. The structure may comprise a plurality of sides, a plurality of side openings and a plurality of covers. The cover is moveable whereby the position of the opening covered by the cover is variable. The plurality of covers are individually moveable. The position of the plurality of openings covered by the plurality of covers is variable. The structure further comprises a top and a blocking front. The blocking front is angled to direct air flow through the plurality of openings in the plurality of sides. The plurality of sides may be two sides and the plurality of openings may be two openings, one in each of the two sides. The structure may have an open back whereby the back is closed by placing the structure against the rear wall of the fireplace. The structure has a top which is closed in the area between the blocking front and the two sides. The top extends past the blocking front and has an opening in the area past the blocking front. The cover for the opening does not cover all of the opening even when the cover is fully closed. Air flow is always allowed within the structure. The plurality of covers do not cover all of the plurality of side openings, even when fully closed. The two covers are movably attached to the top. The two covers can be moved, varying the position of the two openings which are covered by the two covers. The volume of air flow through the structure is thereby effected. The plurality of covers each does not extend to the bottom of each of the plurality of side openings. An air gap is created through which air can flow through the structure. The air gap also allows clearance for the movement of the plurality of covers. The structure comprises a top, a first side, a second side, a first opening in the first side, a second opening in the second side, a first side flap, a second side flap, an angled blocking front and securing means. Air flow from the clean-out opening of the fireplace flows into the structure and out of the first and second openings of the structure, thereby providing air for the fireplace. The first and second flaps are separately moveable, thereby varying the flow of air into the fireplace.

The invention will be more fully understood from the following detailed description and appended claims when taken with the drawings in which:

FIG. 1 is a pictorial view of the device 1 placed in fireplace 2.

FIG. 2 is a pictorial view of the device 1 placed in fireplace 2 with side flaps 7 and 8 closed in position for starting a fire.

Figure 7:
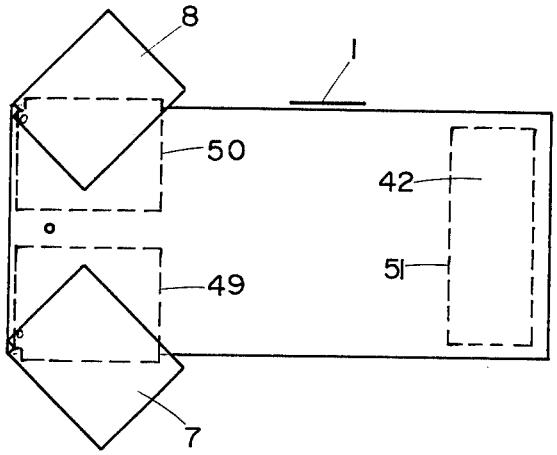

FIG. 7 is a top view of device 1 showing the placement of device 1 over clean-out opening 42 and the range of openings for side flaps 7 and 8.

Figure 1:
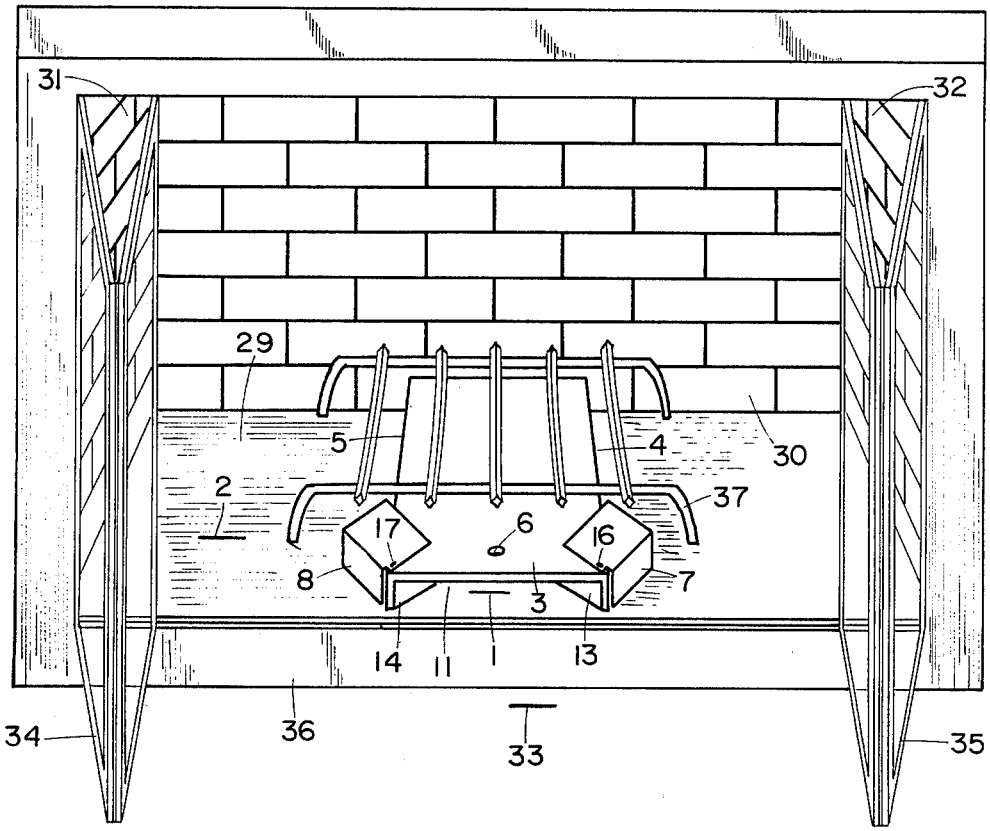

Referring now to the drawings, FIG. 1 is a pictorial view of device 1 placed in fireplace 2. Device 1 is placed in fireplace 2 below grate 37 and above clean-out opening 42 (shown in FIG. 6). Device 1 has a top 3 and sides 4 and 5. Top 3 has a hole 6. Side flaps 7 and 8 are connected through top 3. Side 4 has a side opening 9. Side 5 has a side opening 10. Device 1 has a front opening 11. Fireplace 2 has a fireplace floor 29, back wall 30 and fireplace sides 31 and 32. A front enclosure 33 covers the front opening 11 of fireplace 2. Within front enclosure 33 are front enclosure glass doors 34 and 35 connected above bottom 36 of front enclosure 33.

Figure 2:
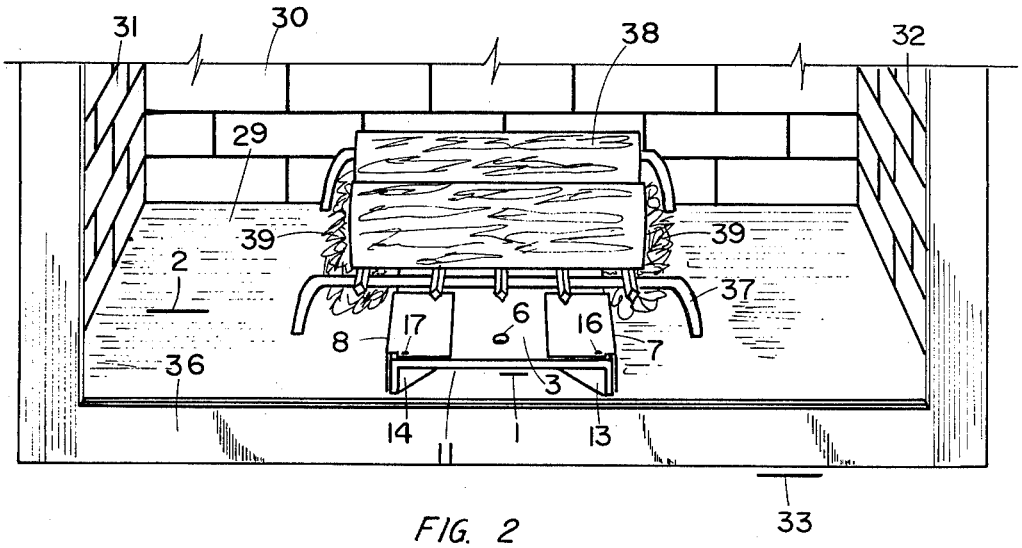

FIG. 2 is a pictorial view of the device 1 placed in fireplace 2. Side flaps 7 and 8 are in the closed position for starting a fire. Logs 38 are placed in grate 37. Wads of paper 39 are place below the logs 38 in grate 37. To start a fire, the wads of paper 39 are ignited. Side flaps 7 and 8 are closed. Even when side flaps 7 and 8 are closed, a small amount of air will enter. That small amount of air provides sufficient oxygen for combustion of the wads of paper 39. When the wads of paper 39 are burning, side laps 7 and 8 may be opened, allowing a greater flow of input air. When the front enclosure glass doors 34 and 35 are closed, the input air through side flaps 7 and 8 provides somewhat of a bellows effect, projecting fire through logs 38.

Figure 3:
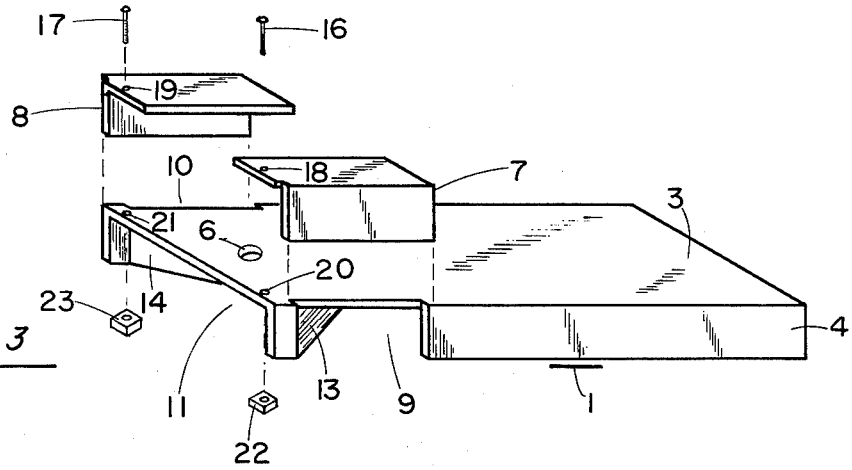
FIG. 3 is an exploded view of device 1.

FIG. 3 is an exploded view of device 1. The top 3 of device 1 has a hole 6 and small holes 20 and 21. Hole 6 may be utilized to be hooked by a poker, or similar device, in order to move device 1. Holes 20 and 21 are used for securing side flaps 7 and 8 to top 3. Side flap 7 is secured to top 3 by use of connecting bolt 16 which is projected through hole 18 in side flap 7. Connecting bolt 16 then goes through hole 20 in top 3 and is secured below top 3 by connecting means 22. Side flap 8 is secured to top 3 by use of connecting bolt 17 which is projected through hole 19 in side flap 8. Connecting bolt 17 then goes through hole 21 in top 3 and is secured below top 3 by connecting means 23.

Figure 4:
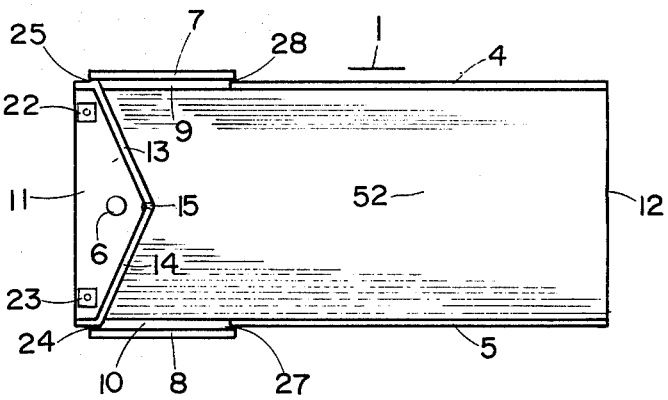
FIG. 4 is a bottom view of device 1.

FIG. 4 is a bottom view of device 1. Air flow is blocked from going through front opening 11 by directional air block pieces 13 and 14. Directional air block pieces 13 and 14 are secured together by weld 15. For greater efficiency and minimum wasted materials and labor in manufacture, directional air block piece 13 may be cut from side 4 of device 1, creating side opening 9. Directional air block piece 14 may be cut from side 5 of device 1, creating side opening 10. When air flow enters beneath device 1, directional air block pieces 13 and 14 prevent the air from flowing through front opening 11 and direct the air toward side openings 9 and 10. Side flap 7 controls the amount of air flow through side opening 9. Side flap 8 controls the amount of air flow through side opening 10. Side flap 7 is designed so that it does not provide an airtight blockage of side opening 9, even when side flap 7 is closed. Side flap 8 is designed so that it does not provide an airtight blockage of side opening 10, even when side flap 8 is closed. When side flap 7 is closed over side opening 9, a front air gap 25 and a rear air gap 28 exists, creating a small air flow through device 1 at all times. When side flap 8 is closed over side opening 10, a front air gap 24 and a rear air gap 27 exists, creating a small air flow through device 1 at all times. Side flaps 7 and 8 provide an air flow through device 1, even when in the closed position, in order to insure proper cooling of device 1 in order to prevent deformity or melting, and to provide an easy method to bank the fire.

Figure 5:
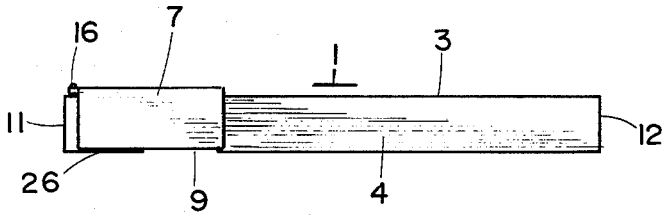
FIG. 5 is a side view of device 1.

FIG. 5 is a side view of device 1. Side flap 7 is not long enough to reach the bottom of side 4, creating an air gap 26. Side flap 8 is not long enough to reach the bottom of side 5, creating an air gap (not shown) similar to air gap 26. Air gap 26 and the air gap not shown allow for some air flow even when side flaps 7 and 8 are closed. Air gaps 26 and the one not shown also allow for free movement of side flaps 7 and 8, providing clearance above the fireplace floor 29, when air flaps 7 and 8 are being adjusted.

Figure 6:
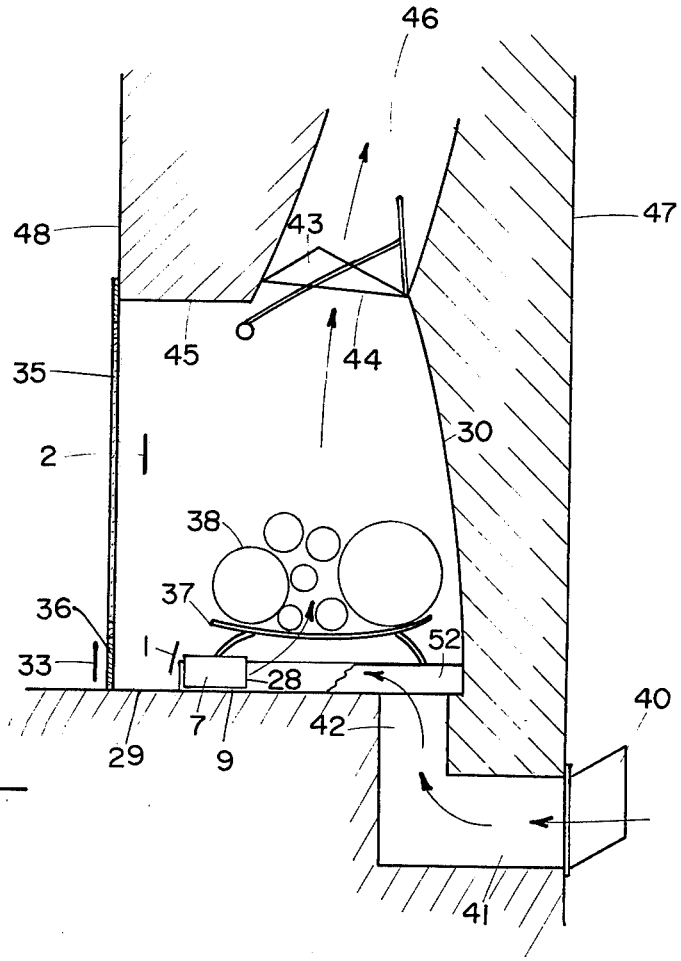
FIG. 6 is a sectional view showing air flow through fireplace 2.

FIG. 6 is a sectional view showing air flow through fireplace 2. The air flow is indicated by arrows. Outside door 40 is open, allowing easy entry of outside air. The air travels through outside door 40 into ash pit 41. The air flows from ash pit 41 through clean-out opening 42. The air flows through clean-out opening 42 into the inside portion 52 of device 1. The air flows through device 1, off directional air block pieces 13 and 14, and out through the openings in side openings 9 and 10 provided by side flaps 7 and 8. The air flows off side flaps 7 and 8 somewhat horizontally and is pulled vertically by the draft of the air into the center area of the fire within logs 38, providing oxygen for combustion. The air flow continues through opening 44 in top 45 of fireplace 2 and through the open damper 43. The air flows from the open damper 43 through air shaft 46, leading outside. Fireplace 2 has an outside wall 47 containing the outside door 40 and an inside wall 48 with an opening covered by front enclosure 33.

FIG. 7 is a top view of device 1 showing the placement of device 1 over clean-out opening 42 and the range of openings for side flaps 7 and 8. Side flaps 7 and 8 are shown in the normally open position. Outline 49 is the closed position for side flap 7. Outline 50 is the closed position for side flap 8. Outline 51 shows the location of clean-out opening 42 beneath device 1.

Utilizing device 1, fireplace ash removal is easily accomplished. It can be accomplished by the use of a poker, or similar device, without touching anything hot or dirty. The grate 37 does not have to be removed. A poker, or similar device, is utilized to engage device 1 through hole 6. Device 1 is lifted and pulled forward. Device 1 may be rested on bottom 36 of front enclosure 33. Utilizing a poker, or similar device, ashes may be pushed toward clean-out opening 42. Ashes will fall through clean-out opening 42 into ash pit 41 where they may be later removed through outside door 40. Device 1 may be relocated in its original position by engaging the device 1 with a poker, or similar device, through hole 6.

Device 1 is useful in banking a fire by providing a small air flow through device 1 sufficient to maintain a slow burn on logs 38. The logs 38 may then be preserved in a condition to continue a large fire at a later time.

Back 12 of device 1 is open. Back 12 is pressed against fireplace back wall 30 to restrict any air flow through back 12. Back 12 could be solid; however, Applicant prefers the open back in order to aid in cleaning ashes and in general convenience.

The invention has been shown with two openings, side openings 9 and 10, and two covers, side flaps 7 and 8. The invention can work with one or more openings and one or more covers. The covers can be connected together or can be individual. Any combination of openings and covers, and any design of openings and covers, is anticipated by this invention. The two covers, side flaps 7 and 8, each comprise a horizontal top section and a vertical side section, as is clearly shown in the drawings.

Side flaps 7 and 8 may be secured through top 3 in any manner desired. A poker, or similar device, may be utilized to open and close side flaps 7 and 8. Directional air block pieces 13 and 14 may be built as one piece extending from side 4 to side 5. To properly place device 1 into fireplace 2, back 12 of device 1 should be pushed against the back wall 30 of fireplace 2. Device 1 should be placed over clean-out opening 42. Ashes from the fireplace 2 can be used to seal the area between sides 4 and 5 of device 1 and the fireplace floor 29. Ashes can also be utilized to seal the area between the back 12 of device 1 and the fireplace back wall 30. Any other means desired to accomplish this sealing is anticipated by this invention. To approach maximum efficiency, the fireplace 2 should be of airtight construction. Should clean-out opening 42 be wider than device 1, then an opening smaller than the width of device 1 may be cut in the clean-out opening cover which covers clean-out opening 42.

Connecting means 22 and 23 may be one or more connecting nuts, or any other kind of connecting means. Washers may be utilized with connecting bolts, screws, nuts, or any other connecting means utilized.

If the front enclosure 33 has a draft control opening, it should be closed for the operation of device 1. Device 1 fulfills all the objectives of the invention. Device 1 allows outside air to be utilized to provide draft for fireplace combustion. Device 1 has a variable air control system utilizing side flaps 7 and 8. Device 1 brings in the outside air through the clean-out opening 42 found in most fireplaces. Device 1 gives greater efficiency in the use of the fireplace. Device 1 controls directional flow and volume of the outside air entering the fireplace. Device 1 is designed to be built with a minimum of wasted materials and labor. Device 1 has side flaps 7 and 8 which allow air flow even when the side flaps are in the closed position.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

I claim:

1. A device for providing air for a fireplace with a clean-out opening comprising a portable structure placed over the clean-out opening of said fireplace comprising:

(a) a horizontal planar top surface;

(b) a first vertical outer side wall facing an interior wall of said fireplace connected to said top surface, (c) a second vertical outer side wall facing an interior wall of said fireplace connected to said top surface;

(d) a first opening in said first outer side wall;

(e) a second opening in said second outer side wall;

(f) a first outer side wall adjustable cover connected to said top surface operative to cover said first opening in said first outer side wall;

(g) a second outer side wall adjustable cover connected to said top surface operative to cover said second opening in said second outer side wall;

(h) securing means operative to secure said first outer side wall adjustable cover and said second outer wall adjustable cover to said top surface;

(i) an angle blocking front wall secured to said top surface, said first outer side wall, and said second outer side wall;

(j) an open back, said open back being defined by said top surface, said first outer side wall and said second outer side wall, and being closed by placing said portable structure against the rear wall of the fireplace;

whereby air flowing from said clean-out opening of said fireplace flows into said portable structure and out of said first opening and said second opening of said portable structure thereby providing air for said fireplace.

2. A device according to claim 1 wherein said angled blocking front wall is angled to direct air flow through said first opening in said first outer side wall and said second opening in said second outer side wall.

3. A device according to claim 1 wherein said top surface extends past said angled blocking front wall and has an opening in the area past said angled blocking front wall.

4. A device according to claim 1 further comprising an air gap between said first outer side wall adjustable cover and the floor of said fireplace when said first outer side wall adjustable cover is fully closed, allowing an air flow through said portable structure.

5. A device according to claim 4 further comprising an air gap between said second outer side wall adjustable cover and the floor of said fireplace when said second outer side wall adjustable cover is fully closed, allowing an air flow through said portable structure.

6. A device according to claim 1 further comprising an air gap between said second outer side wall adjustable cover and the floor of said fireplace when said second outer side wall adjustable cover is fully closed, allowing an air flow through said portable structure.

7. A device according to claim 1 wherein said first outer side wall adjustable cover and said second outer side wall adjustable cover are individually moveably attached by securing means to said top surface whereby said first outer side wall adjustable cover and said second outer side wall adjustable cover can be moved, varying the portions of said first opening in said first outer side wall and said second opening in said second outer side wall which are covered by, said first outer side wall adjustable cover and said second outer side wall adjustable cover and thereby effecting the volume of air flow through said portable structure.

* * * * *